United States Patent [19]

Moss

[11] 4,354,536

[45] Oct. 19, 1982

[54] GASOLINE DISPENSING NOZZLE

[76] Inventor: Jack Moss, 3400 NW. 48th Ave., Lauderdale Lakes, Fla. 33319

[21] Appl. No.: 138,605

[22] Filed: Apr. 9, 1980

[51] Int. Cl.[3] ..... B65B 3/04

[52] U.S. Cl. ..... 141/383; 141/207; 141/347

[58] Field of Search ..... 141/207, 311 R, 346, 141/347, 383, 392, 312

[56] References Cited

U.S. PATENT DOCUMENTS 1,877,292 9/1932 Gardner ..... 285/80

2,175,303 10/1939 Muller ..... 141/347 X

FOREIGN PATENT DOCUMENTS 1211782 11/1970 United Kingdom ..... 285/80

*Primary Examiner*—Frederick R. Schmidt

[57] ABSTRACT

A nozzle having a valve housing and an elongated tube extending therefrom. The nozzle is provided with at least a slot near its open end. A latch is mounted within the nozzle which is movable between a first position, extending outwardly of the slot and a second position inwardly within the nozzle. The latch may be spring-biased or normally controlled to extend outwardly, so that once inserted within the vehicle, the gas tank will lockingly engage under its lip. The latch is provided with structure operable from the exterior of the nozzle which can selectively retract the latch and release the nozzle from the gas tank.

8 Claims, 6 Drawing Figures

GASOLINE DISPENSING NOZZLE

BACKGROUND OF THE INVENTION

The present invention relates to apparatus for deterring the theft of gasoline at service station gas pumps.

With the price of gasoline ever-rising, stealing gas at gas pumps is becoming widespread. This is a particular problem at self-service stations where it is a simple matter for anyone to fill the gas tank of the vehicle while the station attendant is busy with another customer, and thereafter to step into the vehicle and drive off without paying. At the current price of fuel, two or three such drive-offs per day is not only costly to the station owner, but can make the difference between success or failure of the station.

It is the object of the present invention to provide apparatus which will prevent the unauthorized theft of gasoline and drive-offs from service station pumps.

It is a particular feature of the present invention to provide an apparatus for retrofitting the gasoline nozzle or forming the gasoline nozzle, so that where it is inserted into the car gas tank neck, it automatically becomes locked to the car and is unaffected by manipulation by the customer, or any unauthorized person. Thus, the customer cannot drive off until the station attendant has collected the money for the gas.

SUMMARY OF THE PRESENT INVENTION

According to the present invention, there is provided a nozzle formed of a valve housing having an elongated tube extending therefrom and provided with at least a slot near its open end. A latch is mounted within the nozzle which is movable between a first position, extending outwardly of the slot and a second position, inwardly within the nozzle. The latch may be spring-biased or normally controlled to extend outwardly, so that once inserted within the vehicle, the gas tank will lockingly engage under its lip. The latch is provided with means operable from the exterior of the nozzle which can selectively retract the latch and release the nozzle from the gas tank.

Preferably, the latch is operable through a rotary key-operated lock, although automatic servo-means may be employed. In one form, the latch may be a pair of toggle bars, and in another form, may be a pair of ratchet bars.

Full details of the present invention are set forth in the following description, and are shown in the accompanying drawings.

DESCRIPTION OF THE INVENTION

Figure 1:
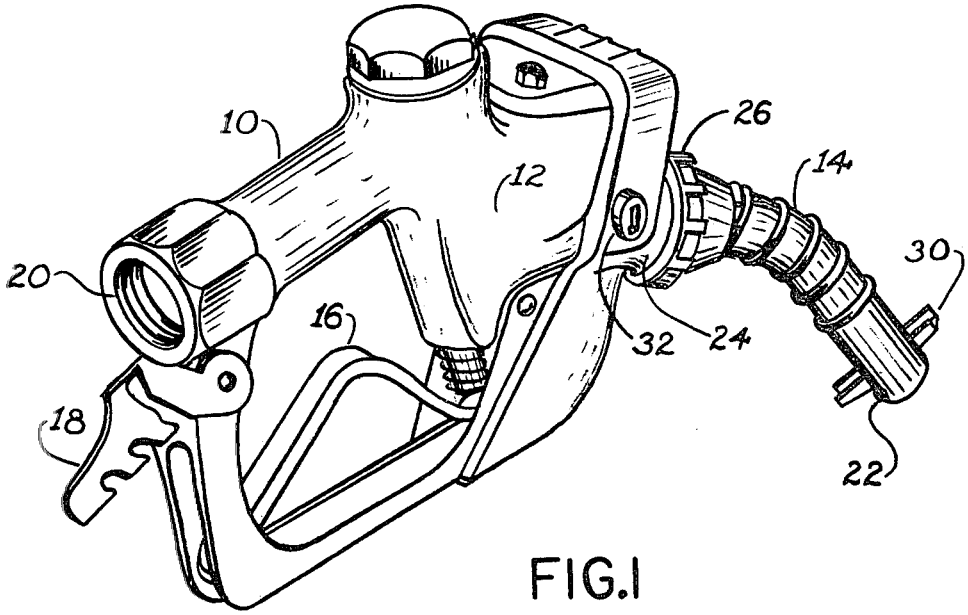
FIG. 1 is a perspective view of a gasoline pump nozzle incorporating the present invention.

As seen in FIG. 1, the nozzle dispenser of the gas supply tank comprises a handle body 10, enclosing a valve 12, from the front end of which protrudes an elongated, generally curved supply tube 14. The valve includes an actuating level 16, a restraining member 18, and an inlet 20. Located about the nozzle is a liquid sensor 22, which acts to release the lever 16 from restraint on filling of the vehicle gas tank. The supply tube 14 is secured to the outlet of the valve 24 by a threaded cap 26.

In conventional nozzle devices, the supply tube 14 is uniform along its length and is easily inserted and removed from the vehicle gas tank. Therefore, no hindrance exists for removal of the device, either before or after completion of fuel dispensing.

According to the present invention, the supply tube is provided with a latch, generally depicted by the numeral 30, which is operable by a lock mechanism, generally depicted by numeral 32, so that on insertion of the tube within the vehicle gas tank, the latch automatically locks therein and is releasable only by an authorized person. Thus, the customer cannot "ride off" without authorization, unless he wishes to risk severe damage to his vehicle, and/or the gas pump.

Figure 2:
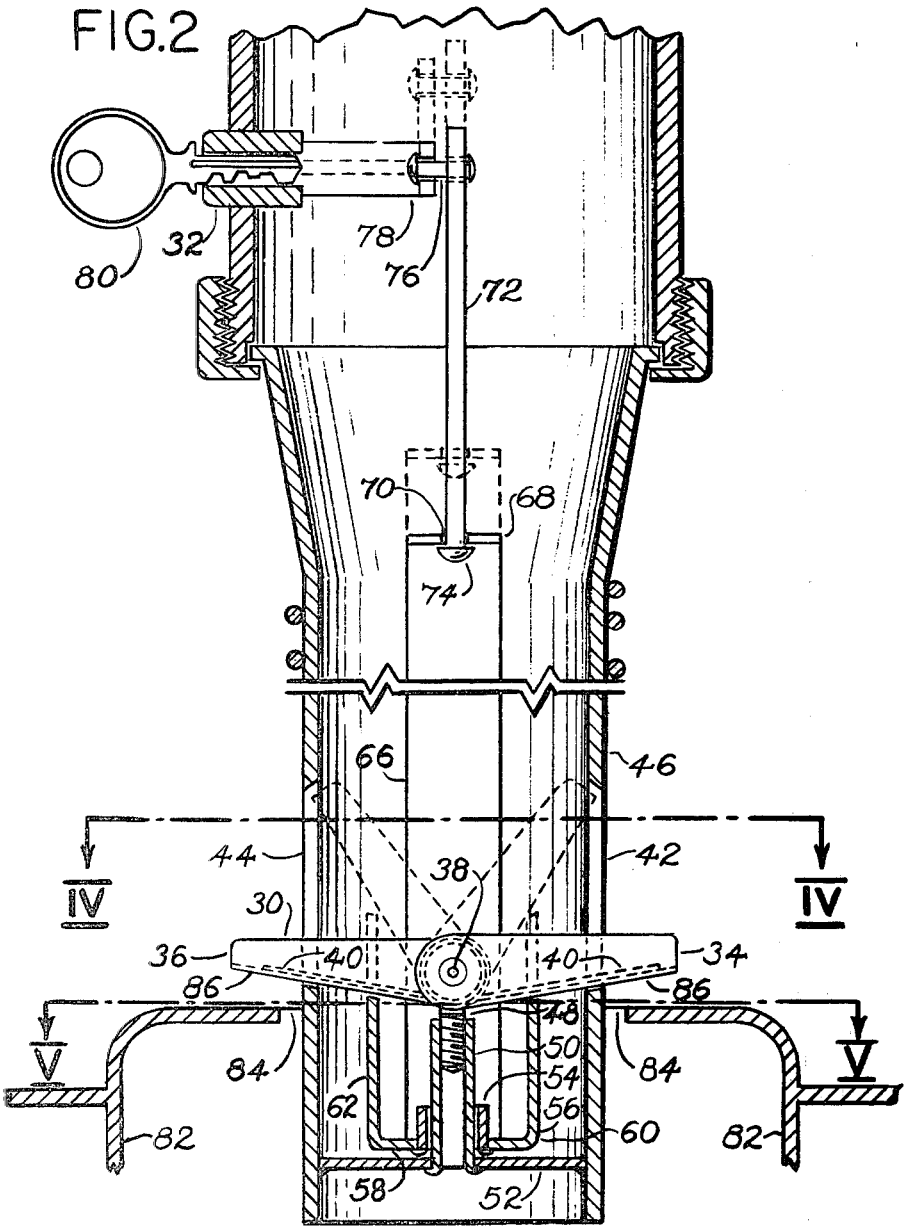
FIG. 2 is an enlarged longitudinal sectional view taken along the center line of the nozzle, showing the present invention in conjunction with a vehicle gas tank.
Figure 3:
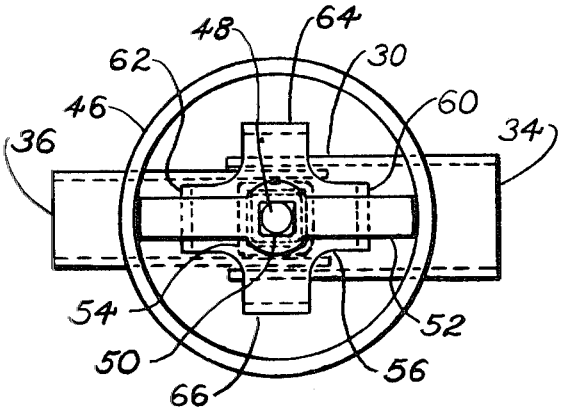
FIG. 3 is an end view looking into the open end of the nozzle.
Figure 4:
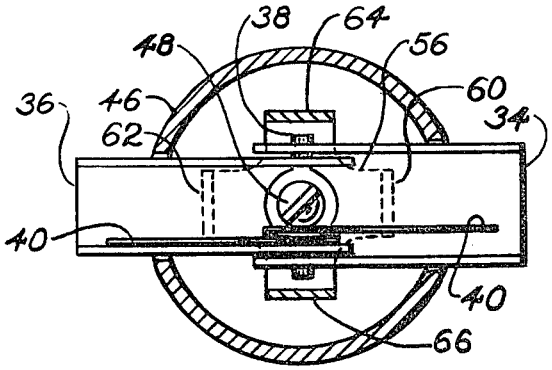
FIG. 4 is a sectional view taken along lines IV—IV of FIG. 2.
Figure 5:
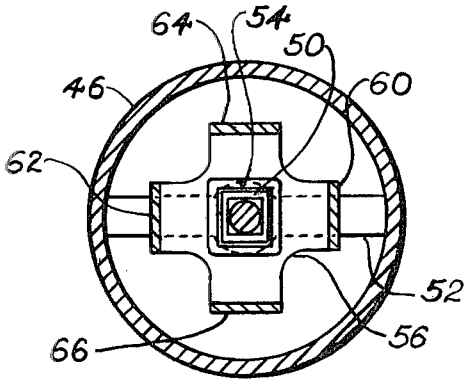
FIG. 5 is a sectional view taken along lines V—V of FIG. 2.

One form of the present invention is illustrated in FIGS. 2–4, where the latch 30 comprises the wing toggle unit formed of a pair of toggle bars 34 and 36, of generally upstanding U-shaped channel mambers which fit telescopically into each other. The bars 34 and 36 are joined at their inner ends by pins 38, so as to be pivotable from a first position, in which they extend perpendicular to the axis of the supply tube to a second position in which they are substantially parallel to the axis. The toggle bars 34 and 36 are spring-loaded by a coiled tension spring 40, wound about the axis of the pins 38, to normally hold the toggle bars in the open, extended position as shown by the solid lines.

Two slots 42 and 44, directly opposite each other, are cut into the cylindrical wall 46 of the supply tube 14, well toward the open end, so that they will easily lie within the vehicle gas tank on insertion. These slots are cut of such length and width, and are positioned with the bottom in a transverse plane, slightly below the pins 38, in such a way as to allow the toggle bars to collapse and retract into the supply tube so that the bars do not extend beyond the outside diameter of the tube, as shown in broken lines, as well as to extend outwardly under the bias of the spring, generally perpendicular to the axis thereof.

The pivot pins 38 are fixed to a screw 48, which is threaded into the end of a rectangular tube 50, which in turn is securely pinned or fixed to a cross bar 52, which is welded to the inside surface of the nozzle wall 46, at its lower end. In this manner, the toggle bars are supported fixedly by the pivot pins 38, so as to remain normally in the biased, extended position for automatic latching, but are pushable into the upward, unlatched position.

To unlatch the toggle bars after they have been inserted into the vehicle gas tank, a device comprising a rectangular hub 54, such as a short, rectangular tube, is fitted slidingly over the threaded rectangular tube 50, mounted on the hub 54, so as to be movable with it as a unitary cross-arm member, generally depicted by the numeral 56. The cross-arm member comprises a bottom plate 58, extending 90° therefrom, and upward within the nozzle, a pair of opposed short arms 60 and 62, and a pair of opposed long arms 64 and 66. The short arms extend upwardly beneath the toggle bars 34 and 36, while the longer arms straddle the toggle bars and extend up through the supply tube. The longer upright arms 64 and 66 are joined by a cross piece 68, which has a hole 70 in its center, through which a loosely fitting bar 72, having a capped end 74, runs up the length of the inside of the supply tube to a position opposite the lock 32. The rod 72 is loosely attached by a pin 76 to a forked bar 78, which constitutes the turning bar of the lock 32, operated by a key 80.

In use, the supply tube is inserted directly into the vehicle gas tank 82, which is provided with an inwardly directed flanged lip 84, having an opening diameter slightly larger than the outside diameter of the nozzle, but smaller than the extended wing spread of the toggle bars 34, 36. In general, gas pumps and vehicles are provided with conforming tank necks and nozzles, so that only one of a kind (leaded or unleaded) gas may be delivered to the vehicle. In either instance, the mouth of the gas tank is only slightly larger than the supply tube. Therefore, when the nozzle is inserted into the vehicle gas tank opening, the immovable flanged lip 84 will of necessity push against the bottom edges 86 of both of the toggle bars 34 and 36, causing them to collapse upwardly through slots 42 and 44, respectively, to the position shown by dotted lines. As soon as the upper ends of the slots 42 and 44 pass the lip of the tank opening, the coil spring 40 automatically causes the toggle bars to spread to their normal original position (full lines). Thus, with the toggle bars now extended past the inner radius of the opening and within the vehicle gas tank, it is no longer possible to extract the supply tube from the car gas tank, and the nozzle is locked therein.

After the vehicle tank is filled and the attendant has checked and collected the money, he then inserts key 80 into lock 32. When the key is turned, it turns the forked bar 78 ninety degrees, which pulls the loosely fitting vertical bar 72 upward inside of the supply tube, pulling the unlocking unit 50 with it. The rectangular hub 54 rides smoothly up the outside of the fixed rectangular tube 50, pulling the two short arms 60 and 62 against the bottom edges 86 of the toggle bars. The pressure of the short arms easily overcomes the resisting pressure of the spring 40 and the toggle once again collapses, retracting the bars 34 and 36 to the position as shown by dotted lines. In this position, with the wings no longer extending beyond the outside diameter of the nozzle, the nozzle can easily be extracted from the car gas tank neck.

Since the key 80 normally remains in the active position, it cannot be taken out of the lock until it is turned back to its original position. At that time the unlocking unit 56 is returned to its original position, taking the pressure off the spring 40, which reasserts itself and causes the bars of the toggle to return to their original extended position.

In lieu of the key-operated lock, a solenoid actuation, remotely controlled, may be mounted on the exterior of the nozzle housing, so that the operator need not walk to the vehicle, and he can release the nozzle from his booth, once the customer pays for the fuel. A solenoid is illustrated in FIG. 6, which also illustrate a different form of latch mechanism.

Figure 6:
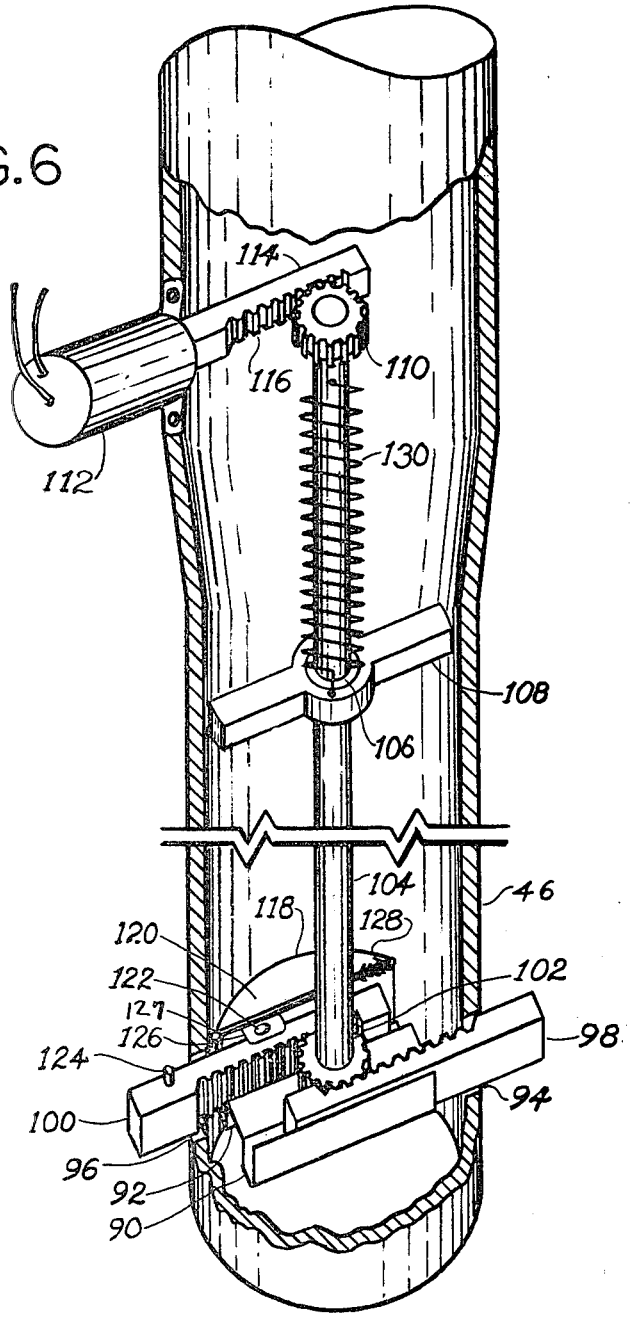
FIG. 6 is a perspective view of a nozzle illustrating another embodiment of the invention.

In the embodiment of FIG. 6, the supply tube is provided with a pair of parallel U-shaped channels 90 and 92, welded just below the slot openings 94 and 96, in a plane generally perpendicular to the longitudinal axis of the supply tube. The channels and slots are not diametrically arranged but offset chordally. Located within each channel is a ratchet bar 98 and 100, respectively, between which is lodged a circular pinion 102. The pinion 102 is fixed at its center to an elongated rod 104, which extends upwardly through the supply tube and which is journalled at its upper end in bearing 106, held by a diametrically extending bracket 108. The upper end of the rod is also fitted with circular pinion 110.

In place of the lock 32, a servo-motor device, such as a remote-controlled push-pull solenoid 112, is mounted on the exterior of the valve housing. The solenoid is provided with a push rod 114, extending radially into the supply tube on a level with the upper pinion 110, and is provided with a ratchet 116 engaging the upper pinion.

Thus, on actuation and de-actuation of the solenoid 112, the push rod extends or retracts radially, rotating the pinion 110, the rod 104 and the lower pinion 102 about its own axis. Rotation of the pinion 102 causes reciprocation of the ratchet bars 98 and 100 in opposite directions, so as to move in unison in the outwardly and inwardly directions to latch and unlatch the supply tube, similar to the aforementioned embodiment. The inward travel or throw of the ratchet bars can be limited by suitable stop means located in the channels 92 or 94, or by the opposite wall of the supply tube, which is not correspondingly slotted.

The solenoid 112 can be actuated by remote switching means from the station operation booth, or it can be automatively actuated, either by contact with the lip of the gas tank or by the first flow of gasoline, through the gas pump, to effect an initial outward bias in the latching position. Suitable and conventional metal or fluid sensors and pulse producers can be so employed. To unlatch and release the supply tube from the vehicle gas tank, switch means operated by the station attendant, on payment of the purchase price, would suffice.

Preferably, the device is arranged so that the ratchet bars 98 and 100 are normally maintained in their retracted position, within the nozzle, so that the nozzle can be easily inserted into the gas tank, but is provided with means to automatically actuate the ratchet bars into their extended position, on the flow of gas through the nozzle.

To effect this, a float device 118 is mounted just above the top surface of the U-shaped channel 90, slidably holding the ratchet bar 100. This float device comprises a semi-circular flap (butterfly) 120, mounted freely on a fixed angle 127, secured along the edge wall of the U-shaped channel 90. A small tab 126, integrally formed with the flap 120, extends inwardly of the nozzle, above the surface of the ratchet bar 100. A coil spring 128, mounted about the axle, bears on the flap 120, and is loaded, so that the flap 120 is held in a normally horizontal position. In this manner, the flap can teeter either upwardly or downwardly about its axle 127, but the spring 128 will always return it to the horizontal position. Mounted to extend upwardly from the upper surface of the ratchet bar is a peg 124. The peg is in alignment with the inwardly extending tab 126, which itself is provided with a hole 122, in which the peg 124 can be received. The underside of the tab is provided with a wedge-like ramp (not seen) on which the pin 124 rides until it seats in hole 122. The pin 124 may be spring-loaded.

A coil spring 130 is placed about the rod 104, with one of its ends seated in the support bracket 108, and the other of its ends secured to the rod 104 itself. The spring 130 is loaded to exert a torque on the rod 104, which normally biases the rod so that it forces the ratchet bars 98 and 100 into an outwardly extending locking condition when the peg 124 is not seated within the hole 122 of the tab 126. Normally, on initiation of the day's operation of the gas station, the attendant sees to it that the solenoid 122 is actuated to pulse the ratchet rod 114, so as to retract the ratchet bars 98 and 100, so that the pin 124 locks itself in the hole 122. The bars thus become locked in retracted position and remain so, until the nozzle is inserted into the gas tank and the first flow of gas through the nozzle occurs.

The flow of the gas through the nozzle strikes the semi-circular float flap 120, which is depressed from its horizontal position. This raises the tab 126, removing the hole 122 from about the pin 124. Thus, the ratchet bar 100 becomes free of any restraint, and the torque exerted by the coil spring 130 asserts itself to extend the ratchet bars 98 and 100 outwardly of the nozzle, within the gas tank, thus locking it therein. When the gas is paid for, the attendant again activates the solenoid 112 to pulse the ratchet rod 114, to retract the ratchet bars 98 and 100.

By the means just described, the nozzle remains fully operational by the customer, requiring no attention by the station operator or attendant, until such time as the gas must be paid for. Thus, the idea of self-service is maintained.

While the key lock is illustrated with the toggle bar unit, and the servo-motor lock is illustrated with the ratchet bar unit, it is contemplated that these arrangements may be interchanged and matched alternately. Key-operated locks of the push-pull (depression) type are well known, as are servo-motors having rotary action rather than push-pull action. Thus, there is no difficulty in such mixing and matching of the various features of either embodiments.

Various other changes, modifications, and variations will be obvious to those skilled in this art. Accordingly, the present disclosure should be taken as illustrative only and not limiting of the invention.

What is claimed is:

1. A nozzle for dispensing gas into a vehicle gas tank having an entrance pipe provided with a radially inwardly directed cap flange, comprising an elongated tube adapted to be axially inserted within the entrance pipe of said vehicle gas tank, a pair of toggle bars pivotally mounted about a common axis within said nozzle, said nozzle having a pair of diametrically opposed slots through which said toggle bars may move, a coil spring mounted about said axis, normally biasing said toggle bars in opposition to each other, extending outwardly through the respective slots, said toggle bars being movable between a first position extending radially outwardly through said slots into position to engage beneath said cap flange, and a second position retracted radially inwardly of said nozzle free of said cap flange, and means for selectively actuating said toggle bars into said first or second position.

2. The nozzle as claimed in claim 1, including unlatching means mounted below said toggle bias and movable upwardly in engagement therewith for collapsing said toggle bars against the bias of said spring, a lever extending longitudinally through said nozzle, said lever being connected to said unlatching means at one end, and a selectively operable locking means at its upper end.

3. The nozzle as claimed in claim 2, wherein said locking means comprises a key-operated lock.

4. The nozzle as claimed in claim 2, wherein said locking means comprises a remote-controlled servomotor.

5. A nozzle for dispensing gas into a vehicle gas tank having an entrance pipe provided with a radially inwardly directed cap flange, comprising an elongated tube adapted to be axially inserted within the entrance pipe of said vehicle gas tank, a pair of opposed slots formed in the wall of said tube, a pair of ratchet bars reciprocable in opposite directions in a plane transverse to the longitudinal axis of the tube, a pinion engaging said ratchet bars, a rod fixed to said pinion extending longitudinally through said tube, a servo-motor mounted on the exterior of said nozzle having connecting means extending within said nozzle in connection with the upper end of said rod, said servo-motor being selectively actuable to rotate said rod to reciprocate said ratchet bars respectively through said slots, said ratchet bars being movable between a first position extending radially outwardly through said slots into position to engage beneath said cap flange, and a second position retracted radially inwardly of said nozzle free of said cap flange.

6. The nozzle according to claim 5, wherein said servo-motor is a push-pull solenoid and said connecting means comprises a ratchet arm connected to the solenoid and pinion fixed to the upper end of said rod.

7. The nozzle according to claims 5 or 6, including means for selectively biasing said servo-motor to effect outward movement of said ratchet bars.

8. The nozzle according to claim 7, wherein said biasing means includes sensor means for detecting the use of said nozzle.

* * * * *